US008245624B1

(12) United States Patent
Green

(10) Patent No.: US 8,245,624 B1
(45) Date of Patent: Aug. 21, 2012

(54) DECOUPLED MULTIPLE WEAPON PLATFORM

(75) Inventor: Andrew Walter Green, King George, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 164 days.

(21) Appl. No.: 12/807,374

(22) Filed: Aug. 26, 2010

Related U.S. Application Data

(60) Provisional application No. 61/276,163, filed on Aug. 31, 2009.

(51) Int. Cl.
*F41G 3/08* (2006.01)

(52) U.S. Cl. ..... 89/41.15; 89/41.01

(58) Field of Classification Search ..... 89/41.04, 89/41.05, 41.06, 41.15, 41.16, 41.17, 41.18, 89/203, 204, 205, 37.02
See application file for complete search history.

(56) References Cited

U.S. PATENT DOCUMENTS 4,020,407 A * 4/1977 Clement et al. ..... 318/601
4,266,463 A * 5/1981 Saltin ..... 89/41.22
4,885,977 A * 12/1989 Kirson et al. ..... 89/41.05
5,826,819 A 10/1998 Oxford ..... 244/3.14
6,621,059 B1 9/2003 Harris et al. ..... 244/3.2
7,416,154 B2 8/2008 Bittle et al. ..... 244/3.22
7,467,761 B2 12/2008 Yehezkeli et al. ..... 244/3.11
2004/0134340 A1* 7/2004 Quinn ..... 89/41.01
2007/0119296 A1* 5/2007 Niv et al. ..... 89/37.02

* cited by examiner

*Primary Examiner* — Isam Alsomiri
*Assistant Examiner* — John D Cooper
(74) *Attorney, Agent, or Firm* — Gerhard W Thielman, Esq.

(57) ABSTRACT

A Decoupled Elevation, Automatic Drift Correction (DEADCo) Multiple Weapon System is provided for concurrently engaging line-of-sight and indirect-fire weapons against a target. The DEADCo system includes a turret structure, a first cradle and a second cradle. The turret structure is mountable to a vehicle and rotatable in yaw on a turret training drive. The first cradle is mountable to the turret structure. The first cradle has a fire control system, and a first elevation drive rotatable in pitch on which to pivotably mount the line-of-sight weapon. The fire control system relays pointer commands to the first elevation drive. The second cradle is mountable to the turret structure. The second cradle includes a drift correction drive rotatable in yaw and a second elevation drive rotatable in pitch. The fire control system relays the pointer commands to the drift correction and second elevation drives that compensate for drift. The deflection weapon couples to the drift correction and second elevation drives for independent rotations in pitch and yaw.

5 Claims, 3 Drawing Sheets

DECOUPLED MULTIPLE WEAPON PLATFORM

CROSS REFERENCE TO RELATED APPLICATION

Pursuant to 35 U.S.C. §119, the benefit of priority from provisional application 61/276,163, with a filing date of Aug. 30, 2009, is claimed for this non-provisional application.

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The invention relates generally to land-mobile weapons platforms. In particular, this invention relates to a weapons turret that enables concurrent operation of decoupled projectile-launchers that operate using separate targeting operations.

Conventional weapon system concepts, such as the Up-Gunned Weapon Station (UGWS) on the United States Marine Corps (USMC) AAVP7A1 amphibious assault vehicle, mount weapons that fire munitions of a high-velocity, low-angle (also called "flat") trajectory nature (e.g., 0.50 cal M2HB) and weapons that fire lower-velocity munitions subject to large corrections required for range and deflection of the projectiles (e.g., 40 mm MK 19).

The deflection for low-velocity munitions is mainly caused by the "drift" of the projectile while in free flight. The dynamics of a free-flight projectile, especially a spin-stabilized one, induces a motion called drift along the line-of-travel. This arrangement to employ weapons that fire projectiles that behave very different from each other while in free flight degrades an operator's ability to efficiently sight on a target and engage simultaneously with both weapons.

High-velocity, flat-trajectory weapons, such as the .50 caliber M2HB machine gun, require a line-of-sight (LOS) to the target through which the operator sights the weapon and engages the target by aligning the weapon's gun bore-line along the LOS with very small adjustments for drift and compensating for the range by making small elevation adjustments to the weapon. The fired projectiles then fly-out to the target along this general LOS to the target.

This enables a sighting-and-ranging system to be directly coupled to the high-velocity, flat-trajectory weapon. For purposes of this disclosure, this is referred to as an LOS weapon that fires an LOS projectile. As the sight is trained and elevated, the LOS weapon follows the sight direction, adjusting for minor elevation corrections for range-to-target that can be achieved by the turret.

Weapons that fire low-velocity, high-deflection munitions do not follow the LOS to the target and must employ a combination of large elevation and train adjustments to deliver its projectile onto the target. For purposes of disclosure this type is referred to as a deflection weapon. This motion is of such magnitude for particular weapon types (e.g., mortar) that were the deflection weapon sighted along the LOS to the target and a round fired, the projectile would consistently miss the target to one side due to the drift of the projectile, thereby constituting a bias error. An excellent example of this is the 40 mm MK 19 automatic grenade launcher.

The current UGWS weapon system apparatus has the operator utilizing a single sighting system for both weapons, which are tied to the same elevation and train-drive mechanisms. Due to the vastly different ballistic properties of the ammunition types used, the operator must complete a complex series of movements and adjustments in order to range-the-target and sight both weapons properly.

Because the dissimilar weapons are tied to the same elevation and training drives along with the single sighting system, the operator cannot bring both weapons to bear on the target at the same time. Instead, the operator must bring the weapons to bear sequentially, thus consuming valuable time in combat situations. This reduces overall system effectiveness as half of the weapons suite cannot be used in a specific engagement sequence.

SUMMARY

Conventional land-mobile weapons platforms yield disadvantages addressed by various exemplary embodiments of the present invention. In particular, the conventional systems do not permit concurrent targeting by weapons firing munitions with vastly different ballistic properties due to their coupled dependency on the turret for directional aiming (i.e., for making train adjustments).

Instead, various exemplary embodiments provide a Decoupled Elevation, Automatic Drift Correction (DEADCo) Multiple Weapon System for concurrently engaging weapons that fire both high-velocity flat trajectory munitions and low-velocity, high-deflection munitions against a target. The DEADCo system includes a turret structure, a first cradle and a second cradle, both mounted on the turret structure and independent of each other.

The turret structure is mountable to a vehicle and rotatable in yaw on a turret training drive. The first cradle is mountable to the turret structure. The first cradle has a fire control system, and a first elevation drive rotatable in pitch on which to pivotably mount the line-of-sight (LOS) weapon. The fire control system relays pointer commands to the first elevation drive.

The second cradle is mountable to the turret structure. The second cradle includes a drift correction drive rotatable in yaw and a second elevation drive rotatable in pitch. The fire control system relays the pointer commands to the drift correction and second elevation drives that compensate for drift. The low-velocity, high-deflection weapon couples to the drift correction and second elevation drives for independent rotations in pitch and yaw.

In various exemplary embodiments, the fire control system further includes a sighting mechanism for detecting the target, a target ranging apparatus for determining range to the target, and a computation processor for pointing the LOS weapon.

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which.

DETAILED DESCRIPTION

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

The purpose of the Decoupled Elevation, Automatic Drift Correction (DEADCo) Multiple Weapon System is to provide a single weapon platform capable of simultaneously utilizing weapons of both high-velocity, flat trajectory (herein called "LOS") and low-velocity, high-deflection (herein called "deflection") natures. When such weapons are coupled together in a single weapon platform, the weapons system operator is at a severe disadvantage in combat as these weapons require different methods of engaging a target at a given range.

The DEADCo Multiple Weapon System allows for two (or more) dissimilar weapon types to be mounted together into a single weapon system. The concept allows for the single sighting-and-ranging system to allow for the proper aiming adjustments to be made for all mounted weapons. This enables the system operator to engage a target with all mounted weapons concurrently or even simultaneously.

The key to the concept is twofold. First, the weapons are on separate elevation axes, each weapon directed with its own drive system. Second, the automatic drift correction cradle allows the deflection weapon to be sighted onto the target by automatically correcting for the drift of the projectiles for a given range input.

Figure 1:
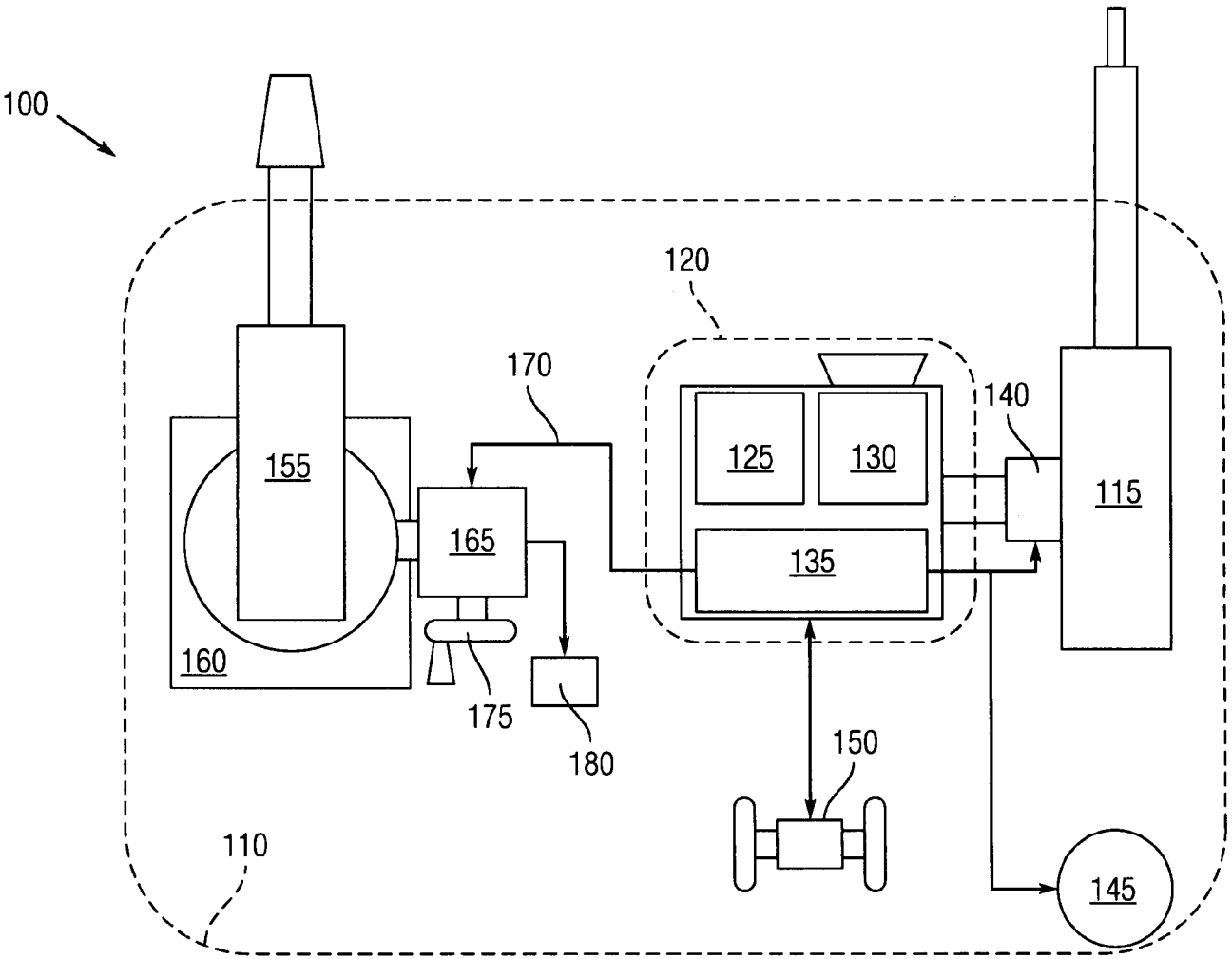
FIG. 1 is a block plan view of a land-mobile weapons platform turret.

FIG. 1 shows a block plan view 100 of a weapons turret. The system on a turret 110 or other such mounting structure provides a single housing and training drive system. An LOS weapon 115 mounted to the turret 110 does not require large adjustments for projectile drift. Consequently, the LOS weapon 115 is coupled directly to the stabilized fire control system 120.

The fire control system 120 includes three elements: the target ranging apparatus 125, the combination day-and-night-time sighting mechanism 130, and the computation processor 135 that computes the gun pointing commands for the LOS weapon 115 based on various stabilization, meteorological, and ballistic inputs. These commands direct both the elevation drive 140 for the LOS weapon 115 and training drive 145 for the turret 110. As implied, the LOS weapon 115 is stabilized in this manner, and the turret 110 can be slewed (e.g., trained) to track and engage a moving target. The fire control system 120 and LOS weapon 115 can be manually directed by the hand controls 150.

A deflection weapon 155 is mounted separately to the turret 110 and rests in the automatic drift correction cradle 160. This cradle 160 contains a combination elevation-and-train drive mechanism 165. Upon receipt of a range input 170 (via either mechanical or electrical sources) from the fire-control system 120, the elevation-and-train drive mechanism 165 moves the cradle 160 to the appropriate elevation and train angles. The cradle 160 automatically trains the deflection weapon 155 to the proper train angle to adjust for deflection of the ammunition type used for a given range while simultaneously elevating the deflection weapon 155 to the appropriate elevation angle based on gun pointing commands from the computation processor 135 in the controller system 120.

No separate fire control computation of train angle for drift correction is required as a single range input 170 accomplishes this automatically. Thus the deflection weapon 155 can be brought to bear even on a target moving relative to the turret 110, as long as the fire control system 120 is providing range inputs 170 to the automatic drift correction cradle 160 combined with the drive mechanism 165.

In the event of power loss, a manual input mechanism 175 can be used to drive the deflection weapon 155 to the proper elevation and train angles. A manual range indicator 180 is also used in conjunction with the combination and manual drive mechanisms 165 and 175 on the automatic drift correction cradle 160.

Figure 2:
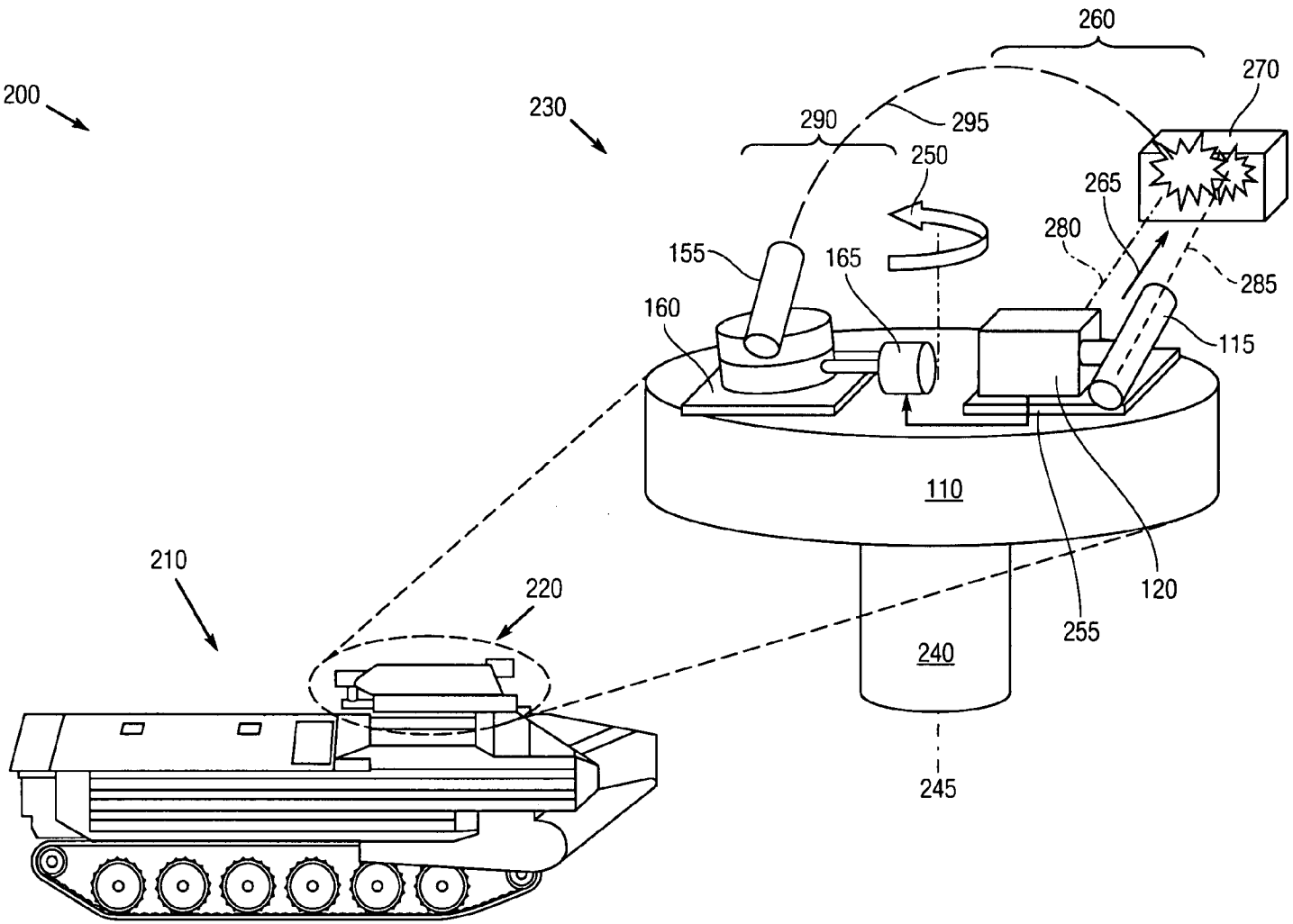
FIG. 2 is a block isometric view of the weapons turret.

FIG. 2 shows a block isometric view 200 of the weapons turret 110 along with a side view of a UGWS platform vehicle 210. A turret assembly 220 sits atop the vehicle 210. An expanded isometric view 230 shows the turret structure 110 mounted to a turret training drive 240 having a vertical axis of rotation 245 to pivot in yaw 250 for azimuth adjustment. The LOS weapon 115 attaches to the fire control system 120 mounted to a coupled sight-and-direct-fire weapon cradle 255.

These elements represent a high-velocity, flat trajectory system 260 having a line-of-sight 265 from the turret sight to a target 270. The fire control system 120 emits a range sensing signal 280 to provide a range distance value, against which the LOS weapon 115 can aim for fire at the target 270. The deflection weapon 155 connects to the drift correction cradle 160 and controlled by the drive mechanism 165. These components represent a large-drift correction system 290 that enable the deflection weapon 155 to concurrently launch its weapon against the target 270 by an arc trajectory 295.

Figure 3:
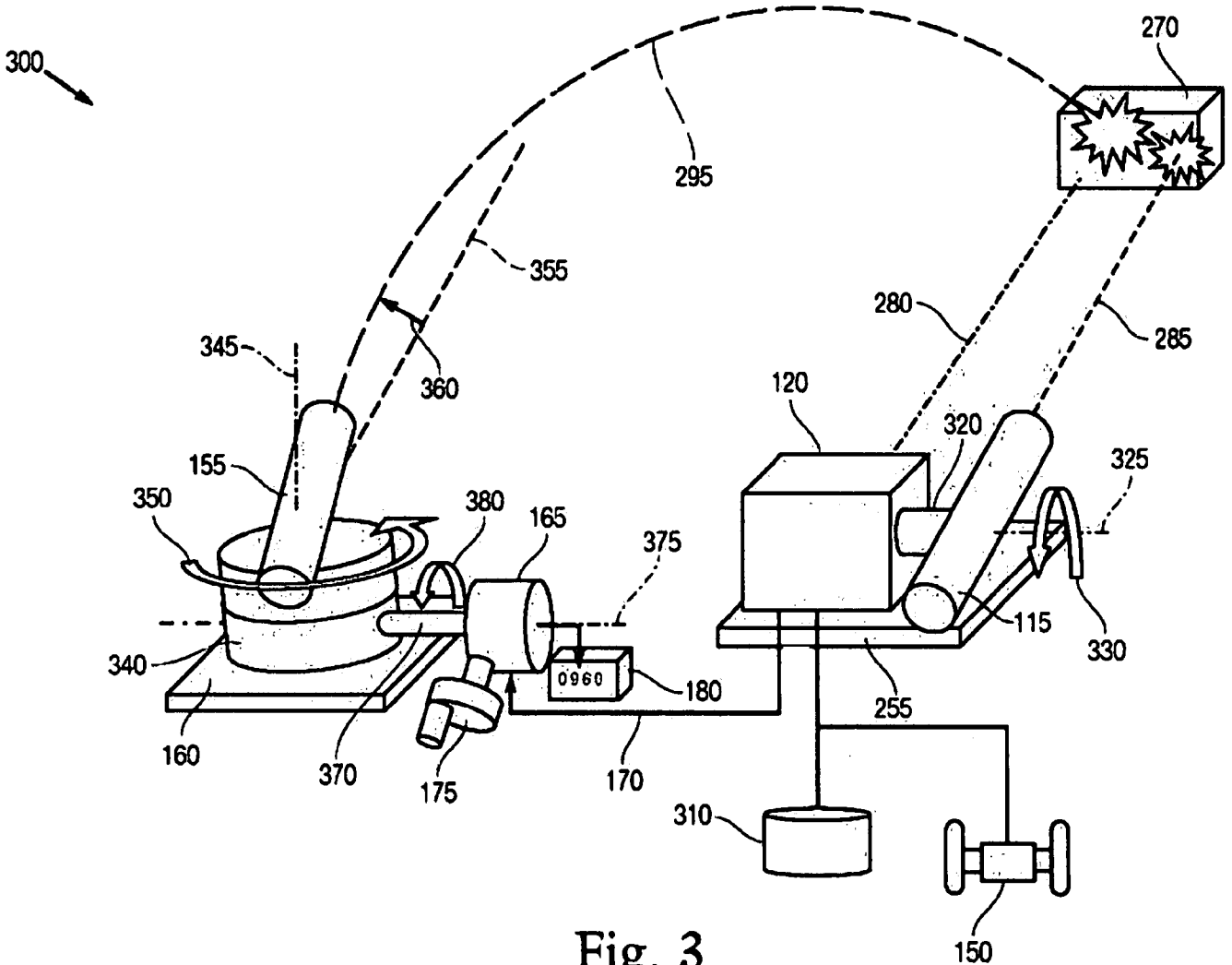
FIG. 3 is a block isometric view of decoupled weapons sighting.

FIG. 3 shows a block isometric view 300 of decoupled targeting operation. A turret training drive 310 enables rotation in yaw for the turret structure 110 in FIG. 1. For the flat trajectory system 260 in FIG. 2, the LOS weapon 115 pivotably mounts to the fire control system 120 and is driven by an elevation drive mechanism 320 along a rotation axis 325 for pitch rotation 330 to adjust aim positioning in altitude to the target 270 along the direct-fire trajectory 285.

For the large-drift correction system 290, the deflection weapon 155 pivotably mounts to a drift correction drive mechanism 340 mounted to the drift correction cradle 160. The drive mechanism 340 rotates on a vertical axis of rotation 345 to pivot in yaw 350 for drift adjustment. Absent the rotation for drift, a projectile launched from the deflection weapon 155 would travel in an uncorrected line-of-fire 355, whereas drift correction 360 adjusts the line of fire to travel along the proper arc trajectory 295.

The elevation-and-train drive mechanism 165 couples to the drift correction drive mechanism 340 along a lateral axis of rotation 375 to pivot in pitch 380 for elevation adjustment of the deflection weapon 155. The manually-operated drive-mechanism 175 (or hand-crank), with its reduction gears, can provide motive force to manually adjust elevation or azimuth of the drive mechanisms in the event of an electrical power cutoff. The drive mechanism 165 receives target distance information from the fire-control system 120 and transfers the information to the range indicator 180 from which the drift correction 360 can be determined. These operations enable both the LOS and deflection weapons 115 and 155 to be independently aimed at the same target 270, without interruption due to coupled aim-adjustment mechanisms.

A typical operator sequence would be as follows:

1) Slew the turret 110 to scan for the target 270;

2) Detect the target 270 with the sighting mechanism 130;

3) Range the target 270 with the ranging apparatus 125;

4) Engage the target 270 by ordering the fire control system 120 to compute a fire control solution, by a) sending gun-pointing commands to the LOS weapon 115 elevation drive mechanism 320 and turret training drive mechanism 310, as well as b) sending the range input to the automatic drift correction cradle drive mechanism 165;

5) Arm the weapons 115 and 155; and

6) Engage the target 270 with any or all weapons as appropriate.

The Advantages of the DEADCo Multiple Weapon System are numerous as compared to current systems that mount both LOS and deflection weapons 115 and 155. They are as follows:

1) Allows for simultaneous engagement of a target 270 by multiple weapons that are of both high-velocity, flat trajectory and low-velocity, high-deflection fire in nature directed by a single fire control system 120 comprising of a sighting 130, ranging 125, and adjustment computation components 135;

2) Simplifies the operator actions by reducing the number of steps required to engage a target 270, especially when switching between the separate weapons 115 and 155;

3) Reduces time for the operator to detect and engage a target 270 with one or more of the weapons 115 and 155;

4) Allows for a variety of different weapon types to be mounted into a single mount or turret structure 110 while nonetheless enabling continual engagement of a target 270; and 5) Improves the reliability of the turret training drive 310 by reducing the wear and tear on the system by constant drift adjustments for the deflection weapon 155; the automatic drift correction cradle 160 executes that function instead.

The Decoupled Elevation Drive Mechanisms between the various weapons represents a novel feature of the DEADCo Multiple Weapons System. Most weapon systems have all weapons coupled on the same axis of elevation and driven by the same elevation drive mechanism. Examples of this paradigm are the 0.50 cal/40 mm UGWS and a co-axial machine gun mounted next to the main weapon on a M1A1/M1A2 Abrams Main Battle Tank. The decoupled elevation drive mechanisms 165 and 320 enable launching weapons ordnance with different ballistic properties to sight-in on the same target 270 concurrently or even simultaneously;

Automatic Drift Correction is provided with the cradle 160 for the deflection weapon 155 to automatically adjust for drift at a given range upon submission of the range input to the elevation drive mechanism 165. This mechanism 165 elevates and trains the deflection weapon 155 independently of the turret (or mount) structure 110 allowing the operator to maintain the LOS to target 270 while engaging with the deflection weapon 155. Thus with a single input (range-to-target), the mechanism provides a full elevation and train angle correction for the deflection weapon 155 without sacrificing ability to engage with the LOS weapon 115.

An alternative to this system is to employ two or more automatic drift correction weapon cradles with a decoupled fire control system. The fire control can then send a single input to all weapon cradles, thus using a single signal to drive gun pointing commands to multiple weapons.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. A Decoupled Elevation, Automatic Drift Correction (DEADCo) Multiple Weapon System for concurrently engaging line-of-sight and deflection weapons against a target, said system comprising:

a turret structure mountable to a vehicle and rotatable in yaw on a turret training drive;

a first cradle mountable to said turret structure, said first cradle having a fire control system, and a first elevation drive rotatable in pitch on which to pivotably mount the line-of-sight weapon, said fire control system relaying pointer commands to said first elevation drive; and a second cradle mountable to said turret structure, said second cradle having a drift correction drive rotatable in yaw and a second elevation drive rotatable in pitch, said fire control system relaying said pointer commands to said drift correction and second elevation drives that compensate for drift, wherein the deflection weapon couples to said drift correction and second elevation drives for independent rotations in pitch and yaw.

2. The system according to claim 1, wherein said second cradle further includes a manual range indicator.

3. The system according to claim 1, wherein said fire control system further includes a sighting mechanism for detecting the target, a target ranging apparatus for determining range to the target, and a computation processor for pointing the line-of-sight weapon.

4. The system according to claim 1, wherein said first elevation drive is coupled to a manual controller.

5. The system according to claim 1, wherein said second elevation drive is coupled to a manual drive.

* * * * *